US005873949A

United States Patent [19]

Tamm et al.

[11] Patent Number: 5,873,949

[45] Date of Patent: Feb. 23, 1999

[54] DEVICE FOR PRESSURIZED WATER DISCHARGE PIPE

[75] Inventors: Franz Tamm; Arnold Joachim; Hartmut Blank, all of Hennigsdorf; Siegbert Arndt, Hohen-Neuendorf, all of Germany

[73] Assignee: Hennigsdorfer Stahl Engineering GmbH, Hennigsdorf, Germany

[21] Appl. No.: 676,369

[22] PCT Filed: Nov. 14, 1995

[86] PCT No.: PCT/DE95/01654

§ 371 Date: Sep. 17, 1996

§ 102(e) Date: Sep. 17, 1996

[87] PCT Pub. No.: WO96/18467

PCT Pub. Date: Jun. 20, 1996

[30] Foreign Application Priority Data

Dec. 10, 1994 [DE] Germany ..... 44 44 106.1

[51] Int. Cl.[6] ..... B08B 3/04

[52] U.S. Cl. ..... 134/64 R; 134/122 R; 266/112

[58] Field of Search ..... 134/64 R, 122 R, 134/199, 182, 198; 266/112, 113

[56] References Cited

U.S. PATENT DOCUMENTS

| | | | |
|---|---|---|---|
| 1,944,798 | 1/1934 | Mellor | 134/122 R |
| 1,998,192 | 4/1935 | Haswell | 134/122 R |
| 2,196,960 | 4/1940 | Dunn | 134/122 R |
| 2,307,694 | 1/1943 | Malke | 134/122 R |
| 2,623,531 | 12/1952 | Waddington et al. | 134/122 R |
| 2,763,275 | 9/1956 | Cummings | 134/105 |
| 2,893,409 | 7/1959 | Wulf | 134/122 R |
| 3,885,581 | 5/1975 | Dahan et al. | 266/112 |
| 4,064,884 | 12/1977 | Asp | 134/64 R |

FOREIGN PATENT DOCUMENTS

| | | | |
|---|---|---|---|
| 0013230 | 7/1980 | European Pat. Off. . | |
| 0064771 | 11/1982 | European Pat. Off. . | |
| 3325020 | 2/1985 | Germany | 134/122 R |
| 1129246 | 8/1985 | U.S.S.R. . | |

*Primary Examiner*—Frankie L. Stinson
*Attorney, Agent, or Firm*—Jordan and Hamburg

[57] ABSTRACT

A pressurized water drain apparatus, for cooling rolling stock, has a pressurized cooling pipe heat exchanger for applying water through nozzle heads onto the rolling stock in a parallel flow and a storage chamber at an outlet of the cooling pipe heat exchanger. The storage chamber includes a deflection system with guiding funnels, a rolling stock outlet and a water outlet. A steam-barrier chamber is connected to the rolling stock outlet of the storage chamber and has a guide funnel with a diameter B and a bifurcated pipe with an input at a top of the steam barrier-chamber and ducts extending down sides of the steam-barrier chamber with outlets opening into the steam-barrier chamber below the guide funnel a distance A. The steam-barrier chamber further has lower inclined walls converging at an outlet connected to a drain shaft and a funnel structure with inclined walls substantially parallel to the lower inclined walls forming channels between the lower inclined walls and the funnel structure with top inlets disposed beneath the outlet openings of the ducts. A pipe connects the water outlet of the storage chamber to the bifurcated pipe to channel water from the storage chamber through the ducts to pass through the channels defined into the drain shaft to produce suction for drawing water from the steam-barrier chamber. In an advantageous embodiment the inclined walls are inclined in the range of 20° to 50° and distance A ranges from B to 2B.

8 Claims, 2 Drawing Sheets

DEVICE FOR PRESSURIZED WATER DISCHARGE PIPE

BACKGROUND OF THE INVENTION

The present invention relates to a pressurized water drain for a pressurized cooling pipe for directly and intensively cooling rolling stock heated by rolling heat. Liquid cooling medium is applied in a parallel flow through nozzle heads onto the rolling stock and discharged once again over a storage chamber. Cooling pipes of this type are suitable particularly for cooling rolled steel from the rolling heat.

Two constructions of cooling pipes for the direct, intensive cooling of rolling stock are well known: the parallel flow/countercurrent flow cooling pipe for rolling stock of thicker dimensions having low final rolling speeds and the parallel flow cooling pipe for rolling stock of thin dimensions and high final rolling speeds.

The parallel flow cooling pipe, used for thin-walled rolling stock and high final rolling speeds, has undisputed, important advantages for direct, intensive cooling. However, in the case of the known technical constructions, the discharge of the liquid is inadequate, so that the final rolling speeds, practically attainable with previously known parallel flow cooling pipes, are limited.

For rolling stock of thicker dimensions, for which relatively large amounts of water are required for the cooling, the previously used parallel flow cooling pipes are less suitable, since the water flows at the end of the cooling part cannot be controlled adequately. It is well known that the pressurized water, which emerges at the end of the cooling pipe into the rolling heat, in all cases leads to a braking effect on the roll line, regardless of whether the emerging cooling water is dammed up before a subsequent cooling pipe or loses its velocity at the end of the cooling segment. Moreover, the cooling water emerging at the ends of the cooling pipe leads to an undefined cooling, as a result of which the quality of the rolling stock treated therewith is reduced. In order to counteract the emergence of the cooling water at the end of the parallel flow cooling pipe, it is well known to have storage chambers disposed at the end of the cooling pipe. The storage chambers are then followed by a short piece of a countercurrent cooling system which, in the most advantageous case, consists of only one countercurrent head acted upon by so much cooling water that the emergence of the cooling water from the end of the cooling pipe is barely prevented. However, braking forces are produced with this measure, which are already so high, that a buckling of thin roll lines can occur at high final rolling speeds.

The EP 13 230 discloses a pressurized cooling pipe having deflection chambers which have several apertures, or rings, for the passage of the rolling stock, at which either guide funnels or deflections cones are disposed. In the case of this known solution, a stripping effect is achieved largely by the effect that the cross section of a jet is reduced by the apertures and the stripped water is diverted. At the end of the construction a stripping pipe is provided which is perpendicular to the direction in which the rolling stock is moving and is supplied with a liquid or gaseous medium which, as a separate secondary stream, directed on the roll line perpendicular to the direction of movement of the rolling stock, strips the remainder of the cooling water. This known construction operates in such a manner that the cooling water is deflected, dammed up and then partially stripped by the orifices or rings disposed in the deflection chambers. At the same time, in a direction countercurrent to the roll line, the cooling medium is dammed up and, consequently a braking effect is exerted on the rolling stock. Accordingly, large amounts of cooling water cannot be deflected from the rolling direction. Furthermore, due to the free arrangement of the outlet openings of the stripping pipe, only uncontrolled stripping of the coolant residues still adhering to the roll line can be attained.

In accordance with EP 64 771, cooling water is deflected by a deflection chamber connected in series with a storage chamber and baffle plates, which are closed off in the upward direction and are disposed in front of the guiding funnels, feed pipes for a liquid and/or gaseous stripping medium ending in the baffle plates. The disadvantage of this construction is that the cooling water and the steam, formed by the cooling, must be discharged from the storage chamber and from the deflection chamber.

SUMMARY OF THE INVENTION

It is an object of the present invention to provide a pressurized water discharge pipe for a pressurized cooling pipe for the direct, intensive cooling of rolling stock heated by rolling heat. A liquid cooling medium is applied in parallel flow by nozzle heads onto the rolling stock and discharged in a storage chamber, whereby the discharge improves the mode of action of the pressurized water discharge, the effect of steam is reduced and an area of application of a parallel flow cooling pipe is expanded.

The present invention provides a pressurized water drain with a storage chamber at an outlet of a cooling water, and a bent pipe is flanged onto the storage chamber and connected with a bifurcated pipe having ducts which, as seen in the direction of flow, enter from above into a drain and steam-barrier chamber and extend below a guide funnel a length A. Water flows down and out of the ducts of the bifurcated pipe, striking inclined walls adjacent funnel walls, inclined at an angle of 20° to 50°, to pass into a collecting shaft.

The present invention provides that the funnel walls are constructed above the collecting shaft in the drain and steam-barrier chamber.

In one embodiment of the invention, the inclined walls, as well as the parts of the funnel walls running parallel thereto, are disposed at an angle of 30°. The water, flowing down out of the bifurcated pipe, is passed by the inclined walls into a collecting shaft. In this section, the water, coming out of the storage chamber, exerts a suction on the leakage water in the drain and steam-barrier chamber to enhance downward discharge. The funnel walls, disposed alongside the inclined walls, are optionally adjustable in height. Thus, it is possible to configure a distance C between the funnel wall and the inclined wall variably and thus affect advantageously the overall action of the apparatus.

In an embodiment of the present invention a baffle plate is disposed at an end of the drain and steam-barrier chamber, perpendicular to the direction of flow of the cooling medium. By means of this arrangement, deflected water, which still has a very high energy, is broken up and banking up at the lower end of the drain and steam-barrier chamber is avoided.

According to a further advantageous embodiment of the invention, the length A of the course of the ducts of the bifurcated pipe is of the order of B to 2B.

DETAILED DESCRIPTION OF THE INVENTION

Figure 1:
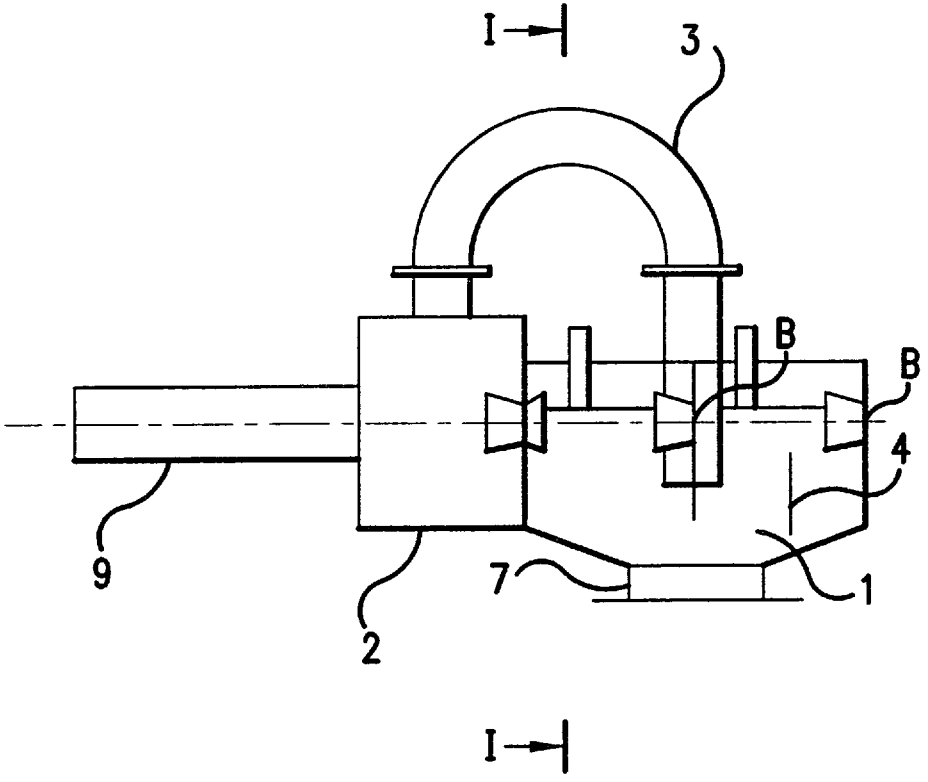
FIG. 1 shows a diagrammatic section of the apparatus.

FIG. 1 shows a diagrammatic representation of an embodiment of the present invention. As seen in a rolling direction, a storage chamber 2, which is connected with a drain and steam-barrier chamber 1, is connected in series with a heat exchanger part 9. At the upper side of the storage chamber 2, a bent pipe 3 is attached by flanges and extends uniformly through a 180° curvature to the drain and steam-barrier chamber 1. At an end of the drain and steam-barrier chamber 1, a baffle plate 4 is disposed in order to limit turbulence of the cooling medium flowing through the drain and steam-barrier chamber 1 in the region of a shaft 7.

Figure 2:
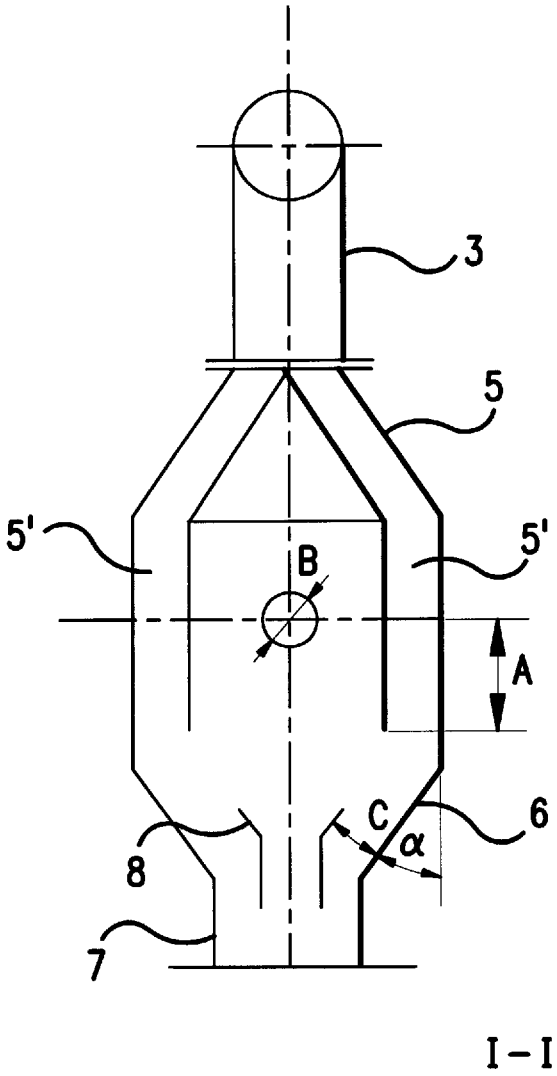
FIG. 2 shows the section I—I of FIG. 1.

FIG. 2 shows the cross section I—I of FIG. 1. In a region of the chamber 1, the bent pipe 3 is connected in series with a bifurcated pipe 5, which is passed on through ducts 5'. The ducts 5' of the bifurcated tube 5 are constructed so as to centrally overlap a guide funnel B and run parallel to walls of the drain and steam-barrier chamber 1 and, with a length A, protrude beyond the positional center of the guide funnel B. The length A is preferably in the range of B to 2B.

Immediately in the region of the shaft 7, angular funnel walls 8 are variably disposed at a distance C from an inclined wall 6 of the drain and steam-barrier chamber 1. The function of the funnel walls 8 is to regulate the water emerging from the ducts 5' and flowing along the walls of the drain and steam-barrier chamber 1.

In the interior of the drain and steam-barrier chamber 1, the funnel walls 8 are parallel to and spaced a distance C from the course of the inclined wall 6 and the wall of the collecting shaft 7. The inclined parts of the funnel walls 8 in the interior of the chamber 1 and the inclined walls 6 of the chamber 1 are inclined at an angle a $\beta$=30° from the perpendicular walls to the center axis of the chamber 1. A strong suction action is thereby produced over the shaft 7 by this arrangement of the funnel walls 8 and the duct formed by these walls. Thus, a reliable discharge of the pressurized water from the drain and steam-barrier chamber 1 is attained and penetration of the cooling water into equipment of the rolling mill disposed downstream is avoided.

We claim:

1. A pressurized water drain apparatus for cooling rolling stock, comprising:

a pressurized cooling pipe heat exchanger having means for applying water through nozzle heads onto the rolling stock in a parallel flow;

a storage chamber at an outlet of said cooling pipe heat exchanger, said storage chamber having a deflection system with guiding funnels, a rolling stock outlet and a water outlet;

a steam-barrier chamber connected to the rolling stock outlet of the storage chamber, the steam-barrier chamber having a guide funnel and a bifurcated pipe with an input at a top of said steam-barrier chamber and ducts extending down sides of the steam-barrier chamber with outlets opening into the steam-barrier chamber below said guide funnel;

said steam-barrier chamber having lower inclined walls converging at an outlet connected to a drain shaft and a funnel structure with inclined walls substantially parallel to said lower inclined walls forming channels between said lower inclined walls and said funnel structure with top inlets disposed beneath said outlet openings of said ducts; and a pipe connecting said water outlet of said storage chamber with said input of said bifurcated pipe to channel water flowing from said storage chamber down out of the ducts of the bifurcated pipe to strike the lower inclined walls and pass through said channels defined by said lower inclined walls and said funnel structure into said drain shaft to produce suction for drawing water from said steam-barrier chamber through said funnel structure and into said drain shaft.

2. The pressurized water drain apparatus of claim 1, wherein said funnel structure includes said inclined walls thereof being two funnel walls constructed above the drain shaft.

3. The pressurized water drain apparatus of claim 1, wherein the lower inclined walls and the inclined walls of the funnel structure are disposed at an angle $\alpha$ of 30° from vertical.

4. The pressurized water drain apparatus of claim 1, wherein:

the ducts of the bifurcated pipe extend below said guide funnel of said steam-barrier chamber a length A;

said guide funnel of said steam-barrier chamber has a diameter B; and said length A corresponds to the magnitude of B to 2B.

5. The pressurized water drain apparatus of claim 1, further comprising a baffle plate disposed at an outlet end of the steam-barrier chamber perpendicular to a direction of flow of the water.

6. The pressurized water drain apparatus of claim 1, wherein the lower inclined walls and the inclined walls of the funnel structure are disposed at an angle $\alpha$ of 20° to 50° from vertical.

7. A pressurized liquid drain apparatus for cooling rolling stock exiting a pressurized cooling pipe heat exchanger having means for applying liquid through nozzle heads onto the rolling stock in a parallel flow, the pressurized liquid drain apparatus comprising:

a storage chamber at an outlet of said cooling pipe heat exchanger, said storage chamber having a rolling stock outlet and a liquid outlet;

a steam-barrier chamber connected to the rolling stock outlet of the storage chamber, the steam-barrier chamber having a guide funnel; and channelling means for introducing liquid from the liquid outlet of said storage chamber into said steam-barrier chamber beneath said guide funnel to create a suction for drawing liquid from said rolling stock.

8. The pressurized liquid drain apparatus according to claim 7 wherein said channelling means comprises:

said steam-barrier chamber having a bifurcated pipe with an input at a top of said steam barrier-chamber and ducts extending down sides of the steam-barrier chamber with outlets opening into the steam-barrier chamber below said guide funnel;

said steam-barrier chamber having lower inclined walls converging at an outlet connected to a drain shaft and a funnel structure with inclined walls substantially parallel to said lower inclined walls forming channels between said lower inclined walls and said funnel structure with top inlets disposed beneath said outlet openings of said ducts; and a pipe connecting said liquid outlet of said storage chamber with said input of said bifurcated pipe to channel liquid flowing from said storage chamber down out of the ducts of the bifurcated pipe to strike the lower inclined walls and pass through said channels defined by said lower inclined walls and said funnel structure into said drain shaft to produce suction for drawing liquid from said steam-barrier chamber through said funnel structure and into said drain shaft.

* * * * *